United States Patent [19]

Morimoto et al.

[11] Patent Number: 4,515,553

[45] Date of Patent: May 7, 1985

[54] COMBUSTION METHOD FOR REDUCING THE EMISSION OF NITROGEN OXIDES

[75] Inventors: Kotaro Morimoto; Tomio Suzuki, both of Kobe, Japan

[73] Assignee: Kobe Steel, Ltd., Kobe, Japan

[21] Appl. No.: 446,037

[22] Filed: Dec. 1, 1982

Related U.S. Application Data

[63] Continuation of Ser. No. 138,757, Apr. 10, 1980, abandoned.

[51] Int. Cl.[3] ..... F23C 5/00

[52] U.S. Cl. ..... 431/8; 431/187; 431/354; 239/423

[58] Field of Search ..... 431/8, 12, 186, 187, 431/188, 279, 284, 157, 158, 354; 239/423, 424

[56] References Cited

U.S. PATENT DOCUMENTS

| | | | |
|---|---|---|---|
| 3,154,134 | 10/1964 | Bloom | 431/186 X |
| 3,671,172 | 6/1972 | Chedaille et al. | 431/284 X |
| 3,748,087 | 7/1973 | Shular | 431/186 X |
| 3,870,456 | 3/1975 | Graat | 431/8 |
| 3,880,571 | 4/1975 | Koppang et al. | 431/8 |

FOREIGN PATENT DOCUMENTS

| | | | |
|---|---|---|---|
| 947621 | 1/1964 | United Kingdom | 431/8 |

*Primary Examiner*—Randall L. Green

*Attorney, Agent, or Firm*—Oblon, Fisher, Spivak, McClelland & Maier

[57] ABSTRACT

The present invention relates to a combustion method for reducing the emission of nitrogen oxides. More particularly, the quick mixing of the air and fuel in the early stage of combustion is suppressed by setting the direction of fuel injection at an angle to the direction of the air stream axis and a position of a burner, in a preferable range resulting in the consequent effective use of a combustion exhaust gas, thereby minimizing the emission of nitrogen oxides to a great extent.

3 Claims, 10 Drawing Figures

COMBUSTION METHOD FOR REDUCING THE EMISSION OF NITROGEN OXIDES

This is a continuation of application Ser. No. 138,757, filed Apr. 10, 1980, now abandoned.

BACKGROUND OF THE INVENTION

The amount of nitrogen oxides (hereinafter referred to as NOx) which forms on combustion of a gaseous, liquid or solid fuel depends on combustion conditions, especially such factors as the flame temperature, oxygen concentration and residence time of burnt gases in the high temperature region, in which the higher the flame temperature and the higher the oxygen concentration, the larger the amount of NOx is produced.

In conventional methods, a burner tip end is kept away from an inner furnace end surface as far as possible, provided that carbon deposits do not accumulate on the surface of the burner tile, not only to increase combustion efficiency but also to shorten the flame length whereby the fuel is quickly mixed with the combustion air and it is ensured to obtain a quick combustion similar to premixture combustion starting from the burner tile bore.

The residence time of burnt gases in the high temperature region is shortened due to the quick mixing and combustion because of the short flame which results in a small radiant heat loss from the flame. Such a quick mixing and combustion elevates the flame temperature and increases the localized oxygen concentration in the combustion zone, with the consequent result of the formation of a large amount of NOx.

SUMMARY OF THE INVENTION

The present invention seeks to solve the aforementioned problems by setting the spread angle of an injection opening section of a burner tile and the position of a burner tip end in a predetermined manner such that the fuel flow rate and fuel injection inclination to the axis of the burner combustion air flow rate ratio is maintained in a preferable range, so. that the emission of NOx can be reduced effectively without undesirable combustion characteristics resulting.

A first aspect of the invention is to provide a combustion method for reducing the emission of NOx. Fuel ejected from the burner is mixed with the combustion air which is supplied through a burner tile which surrounds the burner along the axis thereof. The spread angle of the injection opening section of the burner tile is set to be less than 45°. The distance between the burner tip end and the inner furnace end surface of the burner tile is set to be less than 1.3 times the diameter of the inner furnace end surface bore within the burner tile when the burner tip has a fuel injection opening inclined with respect to the axis of the burner within a range of 5° to 45°, preferably 10° to 30° with respect to the direction of the combustion air flow. The fuel flow rate/-combustion air flow rate ratio is set to be less than 4.0, preferably in the range of 0.7 to 3.0. The distance of the burner tip from the inner furance end surface should be less than 0.8 times the diameter of the inner furnace end surface bore within the burner tile when the burner tip has a fuel injection opening parallel with the direction of the combustion air flow.

A second aspect of the invention, in which a hydrogen-containing gas fuel is employed, is to provide a method for combustion as set forth in the first aspect, wherein the fuel flow rate/combustion air flow rate ratio is set to be less than 1.2.

BRIEF DESCRIPTION OF THE DRAWINGS

Various other objects, features and attendant advantages of the present invention will be more fully appreicated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENT

Figure 1:
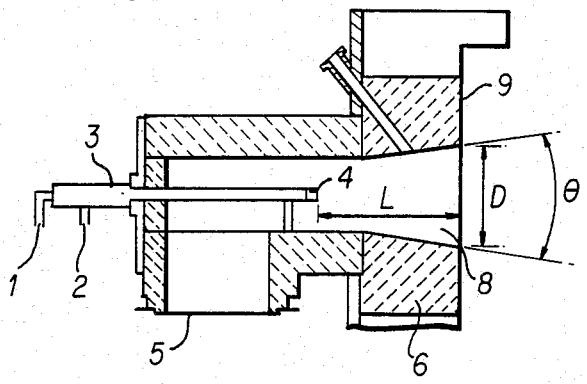
FIG. 1 is a diagrammatic sectional view showing a burner structure for a heavy oil fired soaking pit.

FIG. 1 is a sectional view showing an example of the burner structure for the heavy oil fired soaking pit according to the invention.

The fuel supplied through the fuel feeding line 1 is atomized in the burner 3 by the steam or compressed air supplied through the atomizing medium feeding line 2 and is ejected toward the inside of the furnace from the burner tip 4. The combustion air is ejected toward the inside of the furnace after passing through the burner tile 6 from the combustion air feeding line 5.

The spread angle $\theta$ of the injection opening section of the burner tile 6 is conventionally set in the range of 0° to 90° and the position of the burner tip is conventionally kept away from the inner furnace end surface of the burner tile (6) as far as possible in order to ensure a rapid completion of the quick and uniform mixing and rapid combustion of the ejected fuel and combustion air as mentioned above. In the drawing of FIG. 1, the burner tip is positioned at the lefthand side. Representing the position of the burner tip within the burner tile bore (8) as L/D in which L represents the distance between the inner furnace end surface (9) of the burner tile and the burner tip end and D represents the inner furnace end surface bore diameter of the burner tile, the L/D ratio is usually set around 1.5, for example, as for the soaking pits when the spread angle of the injection opening section of the burner tile is around 45° and the combustion air is supplied along the axis of the burner. In the furnace provided with a mechanism for giving a swirl to the combustion air such as a spiral baffle, the combustion air forms the swirling flow and is mixed with the fuel in the burner tile bore, so that the L/D ratio can be set to be smaller than in the case where the combustion air is supplied along the axis of the burner, that is, the burner tip can be positioned nearer to the inner furnace end surface. But, under such circumstances, the fuel is uniformly mixed with the combustion air and this combustible mixture gas is formed in the burner tile bore, so that combustion starts in the burner tile bore and completes in a short time with an extremely short flame. As a result, this type of combustion causes the emission of large amounts of NOx.

Figure 2:
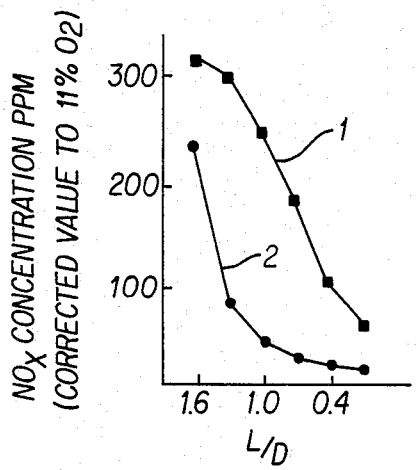
FIG. 2 is a graph showing the relationship between the amount of NOx emission and the position of the burner tip end.

On the other hand, in the method of the present invention, the spread angle of the injection opening section of burner tile is limited to be less than 45° and the L/D ratio is set to be less than 1.3. FIG. 2 shows the relation between the L/D ratio and the amount of NOx emission in ppm, corrected to 11% of oxygen where butane gas is burnt with preheated combustion air at a temperature of 320° C. using a burner tile having the spread angle of the injection opening section being set at 45°. The heat input was 40×10 Kcal/Hr, and the excess air ratio was 1.4 in the combustion test furnace. The furnace volume is represented by the product of a diameter lm×length 4 m.

In the graph, line (1) shows the normal type of burner tip having a straight fuel injection port and line (2) shows the case of the inclined type burner tip having a fuel injection port inclined at an angle of 30° to the axis of burner at its end portion. As shown in the graph, the smaller the L/D ratio, that is to say, the nearer the burner tip end is positioned to the inner furnace end surface, the greater the amount of Nox emission is decreased. A remarkable effect can be obtained when the L/D ratio is set to be less than around 0.8 in the case of the normal type burner tip (1), and less than around 1.3 in the case of the inclined type burner tip (2).

Figure 3:
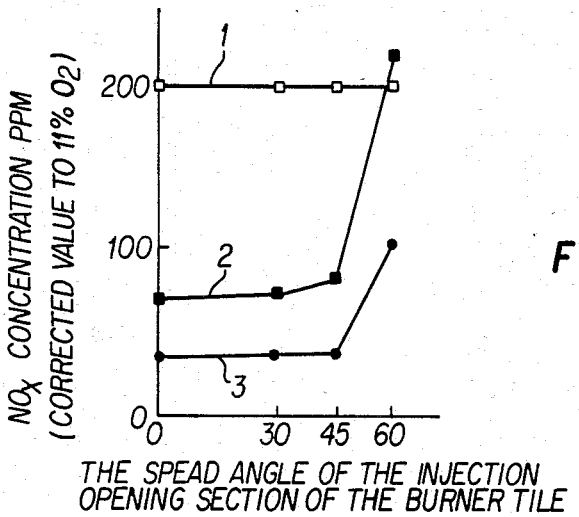
FIG. 3 is a graph showing the relationship between the amount of NOx emission and the spread angle of the injection opening section of the burner tile.

FIG. 3 shows the relation between the amount of NOx emission and the spread angle $\theta$ of the injection opening section of the burner tile in which C heavy oil is burned under the same condition as the above in the same combustion test furnace as above. The spread angle is varied and the burner is of an intenal mixing atomizing type. In the graph, lines 1, 2 and 3 show the L/D ratio being 1.58 with a normal type burner tip, 0.5 with a normal type burner tip and 0.5 with in inclined type burner tip with the inclination angle of 15° respectively. As apparent from the graph, NOx concentration is always of a high value in spite of the variation of the spread angle in the case where the normal type burner tip is used and the position of the burner tip end lies in the conventional range represented by line 1.

On the contrary, in the case where the burner tip end is positioned nearer to the inner furnace end surface as represented by lines 2 and 3, NOx concentration tends to depend on the spread angle. The amount of NOx emission is remarkably reduced when the spread angle is in the range of less than 45°.

Such a NOx emission reducing effect can be obtained both in the cases of the normal type burner tip and the inclined type burner tip. In the case of the inclined type burner tip, a NOx emission reducing rate reaches 80% as shown by line 3. As mentioned in the foregoing, NOx emission is remarkably reduced by positioning the burner tip as near to the inner furnace end surface as possible, but this effect can be obtained only when the spread angle $\theta$ is less than around 45°, the amount of NOx emission is more than that of the conventional method and it brings about a contrary effect. Hence, in order to suppress NOx emission, the spread angle of the injection opening section of the burner tile and the position of the burner tip end should be specified. That is, the spread angle is set to be less than around 45° and the distance between the burner tip end and the inner furnace end surface is set to be less than 0.8 times of the inner furnace end surface bore diameter of the burner tile, namely, the L/D ratio is set to be less than 0.8. Under these conditions, there is no restriction on the shape of the burner tip. Hence, it may be possible to use either the normal type burner tip or the inclined type burner tip. The inclined type burner has a fuel injection port inclined at an angle of around 5° to 45° with respect to the burner axis. An inclination of 10° to 30° is more preferable if a problem such as adherence of the fuel on the burner tile is taken into consideration. A remarkable NOx reducing effect can be ensured by slightly shifting the burner tip end toward the inner furnace end surface in the case of the inclined type burner tip as compared to in the case of the normal type burner tip.

In order to adjust the position of the burner tip end, the burner itself may be shifted toward the inner furnace end surface and also an extension pipe may be provided with the tip portion of the burner or the burner tip may be extended. If there is caused such a problem as melt of the burner tip by shifting the burner tip end toward the high temperature zone near the inner furnace end surface, the steam for safeguard of burner may be fed to the periphery of the burner for the protection thereof.

Figure 4:
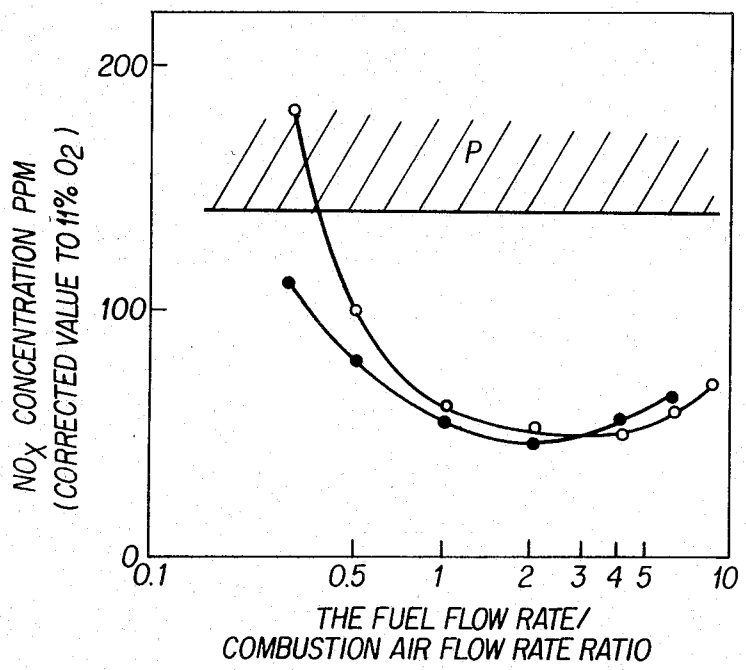

FIG. 4 shows the experimental result of the combustion of butane gas and a mixture gaseous fuel composed of hydrocarbon fuel and blast furnace gaseous fuel hereinafter referred to as BPG by use of the combustion test furnace having a diameter of 1 m and a length of 4 m.

Combustion conditions are that a furnace temperature is 1300° C., the heat input is 400,000 Kcal/H, residual oxygen concentration is 2.5%, a temperature of preheated combustion air is 450° C., a burner has the inclined type burner tip with the fuel injection port inclined at an angle of 15° and the fuel flow rate/combustion air flow rate ratio is varied by changing the fuel flow rate while setting the combustion air flow rate at a constant rate of 25 m/S. In the graph, the marks o and ● show cases of butane having a calorific value of 28,000 Kcal/Nm$^3$ and BPG having a calorific value of 10,000 Kcal/Nm$^3$.

As apparent from FIG. 4, the amount of NOx emission depends on the fuel flow rate/combustion air flow rate ratio and also on the kind of gas, but NOx emission can be effectively suppressed by setting that ratio in the range of 0.5 to 4.0. It is apparent from FIG. 4 that NOx emission can be more suppressed as compared with the case of combustion of butane gas by use of a conventional burner with a NOx formation of 120–300 ppm, represented by an oblique line portion P. Other gases also show a similar result.

Figure 5:
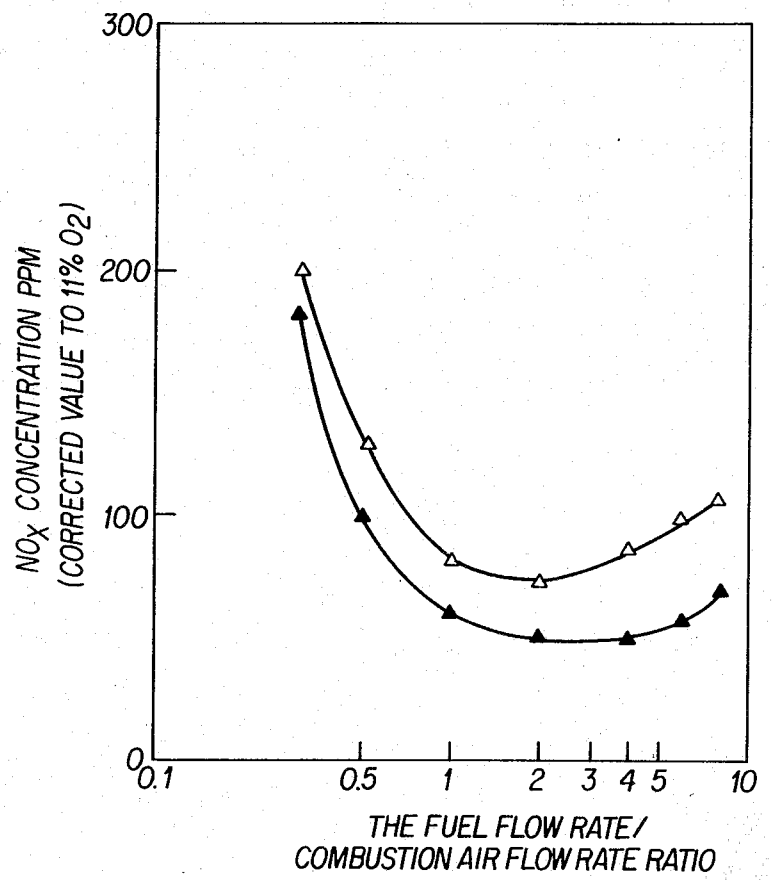
FIGS. 4, 5 and 6 are graphs showing the result of experiments with respect to the relationship between the amount of NOx emission and the fuel flow rate/-combustion air flow rate ratio.

FIG. 5 shows the relation between the amount of NOx emission and the fuel flow rate/combustion air flow rate ratio in which butane gas is burned and the air flow rate is varied. The marks Δ and ▲ show cases of the combustion air flow rate being 70 m/S and 50 m/S, respectively.

As apparent from FIG. 5, the higher the level of the combustion air flow rate, the larger the amount of NOx emission. It is recognized that the low NOx emission range of the flow rate ratio does not change so much in spite of the variation of the combustion air flow rate and the aforementioned range of 0.5 to 4.0 is effective to suppress the NOx emission.

The range of 0.7 to 3.0 is more preferable to prevent adherence of the carbon deposits on the burner tile in consideration of the reduction of NOx emission and pressure adjustment of the fuel and the combustion air.

Figure 6:
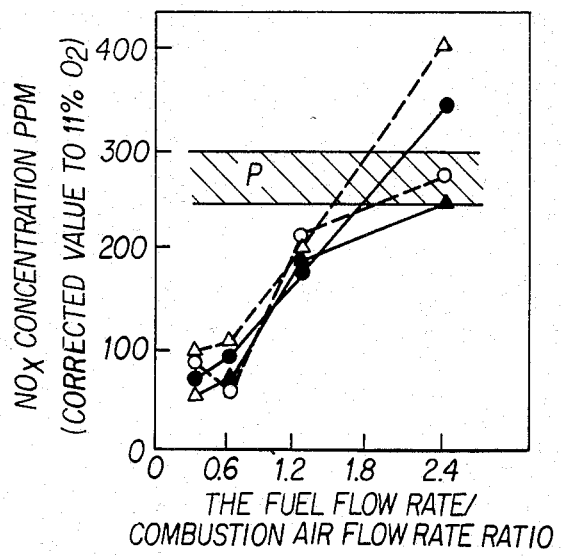

FIG. 6 shows the experimental result in which the present invention is applied to hydrogen-containing coke oven gas including the following components: $H_2$: 59.7%, $CH_4$: 28.5%, CO: 5.3%, others CnHm, $CO_2$, $N_2$. In the graph, the marks Δ, ▲, o and ● show the fuel injection port inclination angles of 15°, 15°, 30° and 30°. The heat input being 400,000 Kcal/H, 200,000 Kcal/H, 400,000 Kcal/H and 200,000 Kcal/H, respectively. As apparent from FIG. 6, the amount of NOx emission is influenced by the fuel flow rate/combustion air flow ratio. The smaller this ratio, the more the NOx emission is suppressed. According to the conventional combustion method, the amount of NOx emisison is 250 to 300 ppm represented by an oblique line portion (P) in the graph. When the present invention is applied to hydrogen-containing gas, the fuel flow rate/combustion air rate ratio may be set to be less than 1.2 to obtain 20 to 80% of NOx reducing rate.

The following embodiments are given to illustrate the effects of the invention.

EMBODIMENT 1

In the top one way soaking pit having a maximum heat input of $650\times10^4$ Kcal/H, and an oil burner of the internal mixing air atomixing type, C (No. 6) heavy oil was burned according to the conventional method and the method of the present invention. Results of both cases were compared with respect to NOx emission. In the conventional method, the normal type burner tip which has the fuel injection port aligned parallel with the burner axis was used and set at a position of the L/D ratio at 1.47. In the present method, the inclined type burner tip having an inclination angle of the fuel injection port set at 15° was used and set at a position of the L/D ratio at 0.7. In each case, the spread angle of the injection opening section of the burner tile was 15°.

Figure 7:
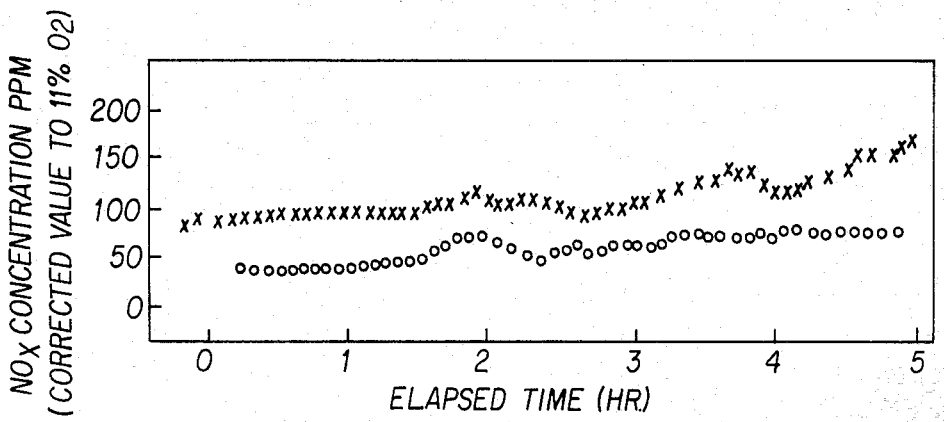
FIGS. 7, 8 and 10 are graphs showing a time lapsed change of the amount of NOx emission in the soaking pit.

FIG. 7 shows a measuring result of the time lapsed change of the amount of NOx emission in one heat cycle of the aforementioned soaking furnace. In FIG. 7, (1) and (2) indicate results of the conventional method and the present method, respectively. As apparent from this graph, the amount of NOx emission exceeds 100 ppm and increases with the lapse of time in the case of the conventional method. But, in the case of the present method, the amount of NOx emission is less than 100 ppm, which is less than half of the above conventional case, and it increases only slowly with the lapse of time and remains stable at low NOx level.

EMBODIMENT 2

Working furnace: top one way soaking pit
Capacity: 240 ton/charge
Dimension: 5.5 m×8.2 mL×4.8 mH
Fuel: butane gas (calorific value: 28,000 Kcal/$Nm^3$) and BPG (calorific value: 10000 Kcal/$Nm^3$
Conditions for combustion
- Excess air ratio: 1.15
- temperature of the combustion air: 250°–500° C.
- combustion air flow rate: 15–60 m/Sec
- The fuel flow rate/combustion air flow rate ratio: 1.0.

Figure 9:
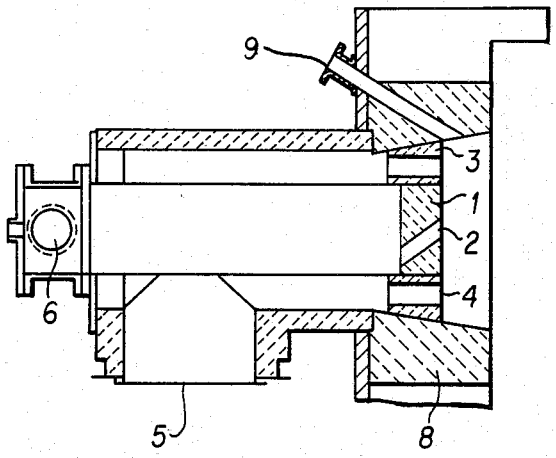
FIG. 9 is a diagrammatic sectional view of a burner structure for the soaking furnace.

The burner used for the experiment is shown in FIG. 9. The burner has one fuel injection port (2) which inclines at an angle of 10°.

Figure 8:
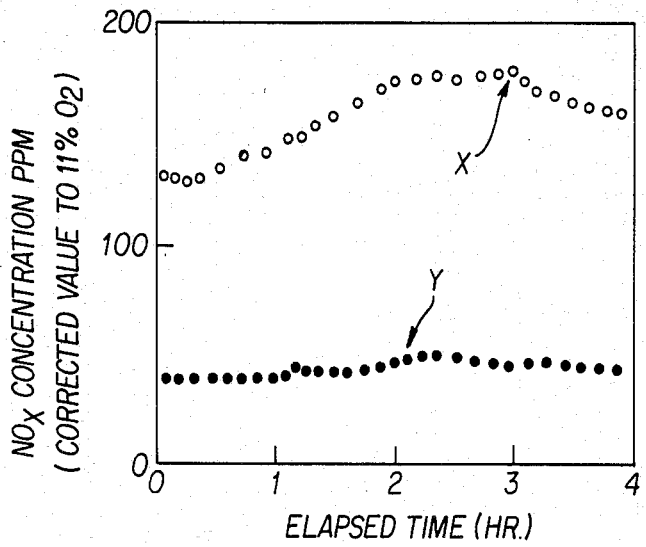

FIG. 8 shows the time lapsed change of the amount of NOx emission in one heat cycle of the above furnace under the same conditions. In FIG. 8, the marks (X) and (Y) show the results of the conventional method and the present method, respectively, as apparent from which the present method suppresses NOx emission remarkably.

EMBODIMENT 3

Working furnace: Top one way soaking pit
Capacity: 133 ton/Hole
Dimension: 3.1 $m^W\times4.7$ $m^H\times8.0$ $m^L$
Fuel: coke oven gas (the same composition as that in the case of test furnace)
Combustion conditions
- The air/fuel ratio: 1.2
- temperature of the combustion air: 205°–500° C.
- combustion air flow rate: 20 m/S–50 m/S
- The fuel flow rate/combustion flow rate ratio: 15°, upward direction The present method was performed by use of the burner, a structure which is shown in FIG. 9. The conventional burner structure was composed of the combustion air spiral baffle with twelve air ports, each having a diameter of 75 mm and a gaseous fuel spinner with four fuel injection parts, each having a diameter of 65 mm, in which the swirling angle was set to be 15°.

The burner structure of the present invention is composed of the combustion air axial flow baffle (3) with twelve air ports (4), each having a diameter of 106 mm, and the fuel burner tip (1) having one fuel injection port (2) with a diameter of 130 mm, the upward inclination angle of which is 15°. In FIG. 9, numerals 5, 6, 8 and 9 denote the combustion air inlet port, the fuel inlet port, the port block and the pilot burner insert opening, respectively.

Figure 10:
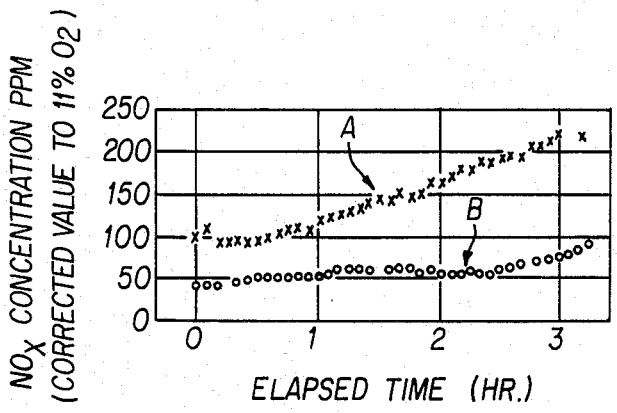

FIG. 10 shows the time lapsed change of the amount of NOx emission in one heat cycle of the above-mentioned furnace under the same condition as described above. In FIG. 10, (A) and (B) denote the results of the conventional method and the present method, respectively. As apparent from FIG. 10, NOx emission can be suppressed to a great extent and the NOx reducing rate is 50 to 70% according to the present method.

As can be seen from the foregoing, according to the method of the present invention, NOx emission can be suppressed remarkably in an easy way, that is, by the setting of the spread angle of the injection opening section of the burner tile, the position of the burner tip end and the fuel flow rate/combustion flow rate ratio, without making major modifications to an existing furnace.

Obviously, numerous modifications and variations of the present invention are possible in light of the above teachings. It is therefore to be understood that within the scope of the appended claims, the invention may be practiced otherwise then as specifically described herein.

What is claimed as new and desired to be secured by Letters Patent of the United States is:

1. A combustion method for reducing emission of oxides of nitrogen in an industrial furnace comprising a combustion chamber, a fuel supply, a burner for burning said fuel with a combustion air, and a port block, wherein said burner further comprises a burner tip, wherein said port block further comprises an inner furnace end surface exposed to said combustion chamber and a bore formed within said port block, wherein said bore includes a conical injection opening defining a spread angle, wherein said method comprises:

introducing said combustion air into said bore coaxially around said burner such that the total combustion air flow into said bore is symmetric about a first axis;

injecting said fuel through said burner tip into said bore such that the total fuel flow into said bore is symmetric about a second axis;

mixing said combustion air and said fuel within said bore;

directing said air and said fuel into said furnace in a substantially diverging conical pattern included within said spread angle;

maintaining said spread angle below 45° such that said air and said fuel form a diverging flow pattern;

maintaining the distance of said burner tip from said inner furnace end surface at less than 1.3 times the diameter of said bore measured at said inner furnace end surface; and maintaining said total fuel flow through said burner tip such that said second axis of said total fuel flow forms an angle between 5° and 45° with respect to said first axis of said total flow of said combustion air, whereby said burning of said fuel is delayed so as to reduce said emission of oxides of nitrogen.

2. A combustion method according to claim 1 which further comprises:

maintaining the ratio of flow rate of said fuel with respect to the flow rate of said combustion air within a range from 4.0:1 to 0.5:1 wherein said fuel comprises mainly gaseous hydrocarbon fuel.

3. A combustion method according to claim 1 which further comprises:

maintaining the ratio of flow rate of said fuel with respect to the flow rate of said combustion air to a ratio between 0.7:1 to 3.0:1.

* * * * *